US009425541B2

(12) United States Patent
Data et al.

(10) Patent No.: US 9,425,541 B2
(45) Date of Patent: Aug. 23, 2016

(54) HIGH POWER ELECTRICAL CONNECTOR

(71) Applicant: Molex, LLC, Lisle, IL (US)

(72) Inventors: Mark M. Data, Bolingbrook, IL (US); Eric P. Bleuel, Woodridge, IL (US); Robert Carlson, Batavia, IL (US); Frank Keyser, Elk Grove Village, IL (US); Eric J. Stenstrom, Warrenville, IL (US); Michael A. Bandura, Naperville, IL (US); Arvind Patel, Naperville, IL (US); David L. Brunker, Naperville, IL (US); David E. Dunham, Aurora, IL (US); Ronald Kulakowski, Aurora, IL (US); Ed Kinsley, LaGrange, IL (US); Robert Smid, Darien, IL (US)

(73) Assignee: Molex, LLC, Lisle, IL (US)

( * ) Notice: Subject to any disclaimer, the term of this patent is extended or adjusted under 35 U.S.C. 154(b) by 117 days.

(21) Appl. No.: 14/390,251

(22) PCT Filed: Apr. 5, 2013

(86) PCT No.: PCT/US2013/035382

§ 371 (c)(1),
(2) Date: Oct. 2, 2014

(87) PCT Pub. No.: WO2013/152261

PCT Pub. Date: Oct. 10, 2013

(65) Prior Publication Data

US 2015/0118902 A1 Apr. 30, 2015

Related U.S. Application Data

(60) Provisional application No. 61/620,663, filed on Apr. 5, 2012.

(51) Int. Cl.
*H01R 24/66* (2011.01)
*H01R 13/66* (2006.01)
(Continued)

(52) U.S. Cl.
CPC ..... *H01R 13/5208* (2013.01); *H01R 13/6315* (2013.01); *H01R 24/28* (2013.01); *H01R 13/565* (2013.01); *H01R 2103/00* (2013.01); *H01R 2201/26* (2013.01)

(58) Field of Classification Search
CPC . H01R 13/5208; H01R 24/28; H01R 13/6315
See application file for complete search history.

(56) References Cited

U.S. PATENT DOCUMENTS 2,715,713 A * 8/1955 Seim ..... H01R 39/00 439/17
3,696,321 A * 10/1972 Cooper, Jr. ..... H01R 9/00 174/152 R (Continued)

FOREIGN PATENT DOCUMENTS

JP 2010-021014 A 1/2010
JP 2011-081957 A 4/2011

(Continued)

OTHER PUBLICATIONS

International Search Report for PCT/US2013/035382.

*Primary Examiner* — Briggitte R Hammond
(74) *Attorney, Agent, or Firm* — James A. O'Malley

(57) ABSTRACT

A high power electrical connector is provided for transmitting electrical signals from a pair of cables, such as high current capable cables, to an associated member, such as a dash panel. The high power electrical connector includes an insulative housing and a pair of contact path assemblies therethrough for transmission of the electrical signals. The cables can be rotated relative to the housing and rotated relative to each other via the contact path assemblies. Ground path assemblies are also provided for grounding the cables. The cables can each be rotatable relative to a portion of the respective ground path assembly.

18 Claims, 13 Drawing Sheets

(51) Int. Cl.

| | |
|---|---|
| ***H01R 13/52*** | (2006.01) |
| ***H01R 13/631*** | (2006.01) |
| ***H01R 24/28*** | (2011.01) |
| *H01R 103/00* | (2006.01) |
| *H01R 13/56* | (2006.01) |

(56) References Cited

U.S. PATENT DOCUMENTS 4,210,379 A * 7/1980 Vachhani ..... H01R 9/2408 439/406
4,408,816 A * 10/1983 Knecht ..... H01R 13/6592 439/470
5,073,127 A * 12/1991 Daly ..... H01R 23/661 439/473
6,118,170 A 9/2000 Takahashi et al.
6,464,538 B2 * 10/2002 Miyazaki ..... H01R 13/4223 439/101
6,638,074 B1 10/2003 Fisher
6,746,284 B1 * 6/2004 Spink, Jr. ..... H01R 13/115 439/651
7,101,217 B2 * 9/2006 Hayashi ..... H01R 13/6592 439/447
7,114,990 B2 10/2006 Bence et al.
7,270,562 B1 * 9/2007 Trout ..... H01R 13/6215 439/364
7,575,476 B2 * 8/2009 Tyler ..... H01R 13/65802 439/101
7,789,690 B1 * 9/2010 Rhein ..... H01R 13/53 439/310
8,851,923 B2 * 10/2014 Klaassen ..... H01R 13/521 439/587
9,048,587 B2 6/2015 Marsh
2004/0198087 A1 10/2004 Lin
2009/0130892 A1 * 5/2009 Pech ..... H01R 13/625 439/374
2010/0093231 A1 4/2010 Lauermann et al.
2010/0173512 A1 * 7/2010 Gilliam ..... H01R 13/622 439/335
2012/0227262 A1 * 9/2012 Gross ..... H01R 13/5837 29/857
2013/0078835 A1 * 3/2013 Gunreben ..... H01R 13/658 439/188
2014/0305696 A1 * 10/2014 Tanaka ..... H01R 12/594 174/71 R

FOREIGN PATENT DOCUMENTS

JP 2011-204423 A 10/2011
KR 10-2006-0045241 A 5/2006
KR 20-2010-0013066 U 12/2010

* cited by examiner

HIGH POWER ELECTRICAL CONNECTOR

This application claims the benefit of U.S. Provisional Application Ser. No. 61/620,663 filed on Apr. 5, 2012, which is incorporated herein by reference in its entirety.

FIELD OF THE INVENTION

The present invention field of connectors, more specifically to the field of connectors suitable for delivery of high power.

BACKGROUND OF THE INVENTION

FIG. 1 illustrates a schematic of a typical connector configuration. Relatively large gauge cables (e.g., 6 gauge and larger) are coupled to a connector and for electric vehicles the connector can be used to electrically connect the wires in an engine/motor compartment with wires on the opposite side of the dash panel. Convention connectors have suffered from a number of issues. On the one hand, the cables need to provide relatively large current—in the range of 80 to 200 amps (or more) along with the possibility of high voltages (200 Volts or more). This tends to require a cable with a large gauge conductor with good insulation that makes the cable relatively difficult to handle during assembly and repair of the vehicle. This issue can be further complicated by the fact that two separate cables can be connected to the connector. Existing designs, because they need a reliable connection, don't allow the cables to rotate independently, which makes assembly and use of such cables more challenging. The cables tend to be shielded so as to help manage EMI but because of the high currents (often with sudden spikes in current) provided on the conductors, the shielding can end up carrying a substantial current as well (potentially in the range of 20 to 80 amps). Consequentially, further improvements to the design of high power electrical connectors would be appreciated by certain individuals.

SUMMARY OF THE INVENTION

A high power electrical connector is provided herein which provides improvements to existing high power electrical connectors and which includes embodiments that overcome certain of the disadvantages presented by the prior art. The high power electrical connector is provided for transmitting electrical signals from a pair of cables, such as bipolar (BP) cables, to an associated member, such as a dash panel. The high power electrical connector includes an insulative housing and a pair of contact path assemblies therethrough for transmission of the electrical signals. The cables can be rotated relative to the housing and rotated relative to each other via the contact path assemblies. Ground path assemblies are also provided for grounding the cables. The cables are rotatable relative to a portion of each ground path assembly.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1:
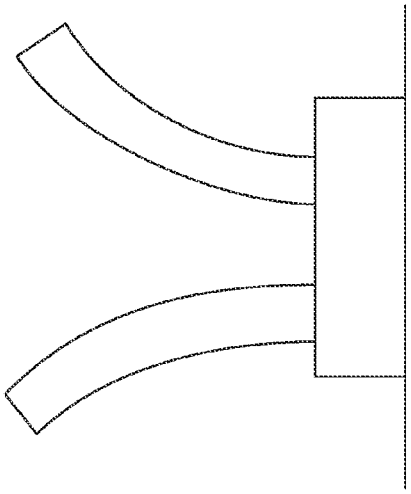
FIG. 1 (PRIOR ART)
FIG. 1 is a side elevational view of a prior art connector configuration.
Figure 2:
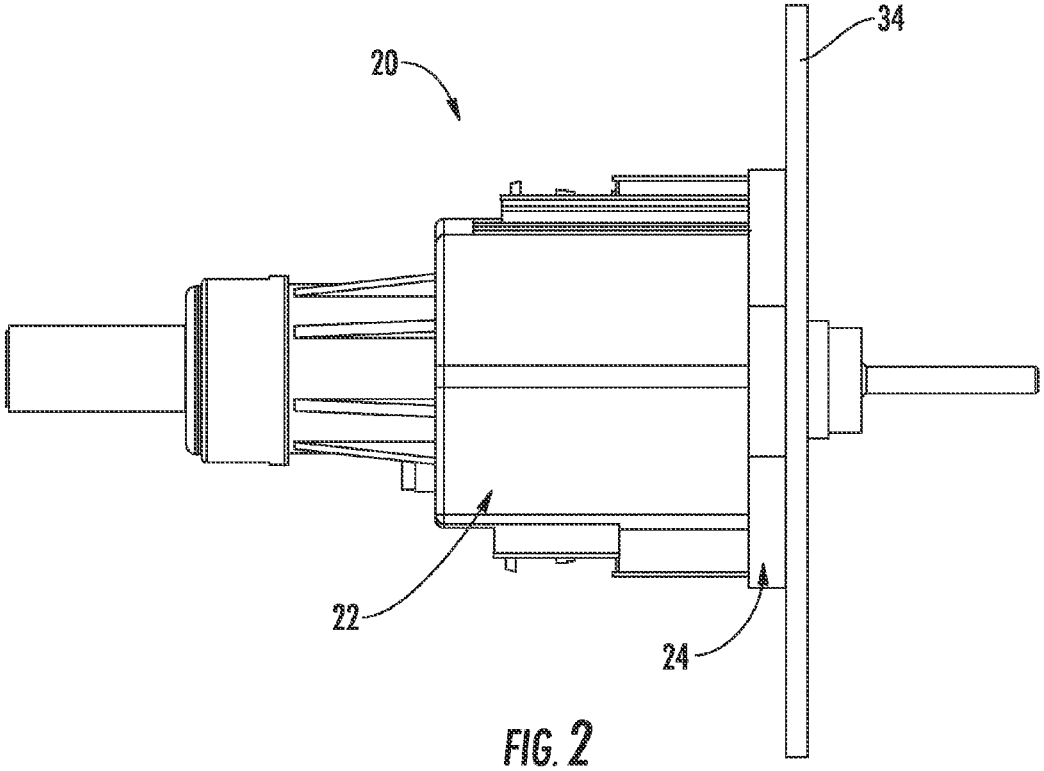
FIG. 2 is a side elevational view of an embodiment of a high power electrical connector.
Figure 3:
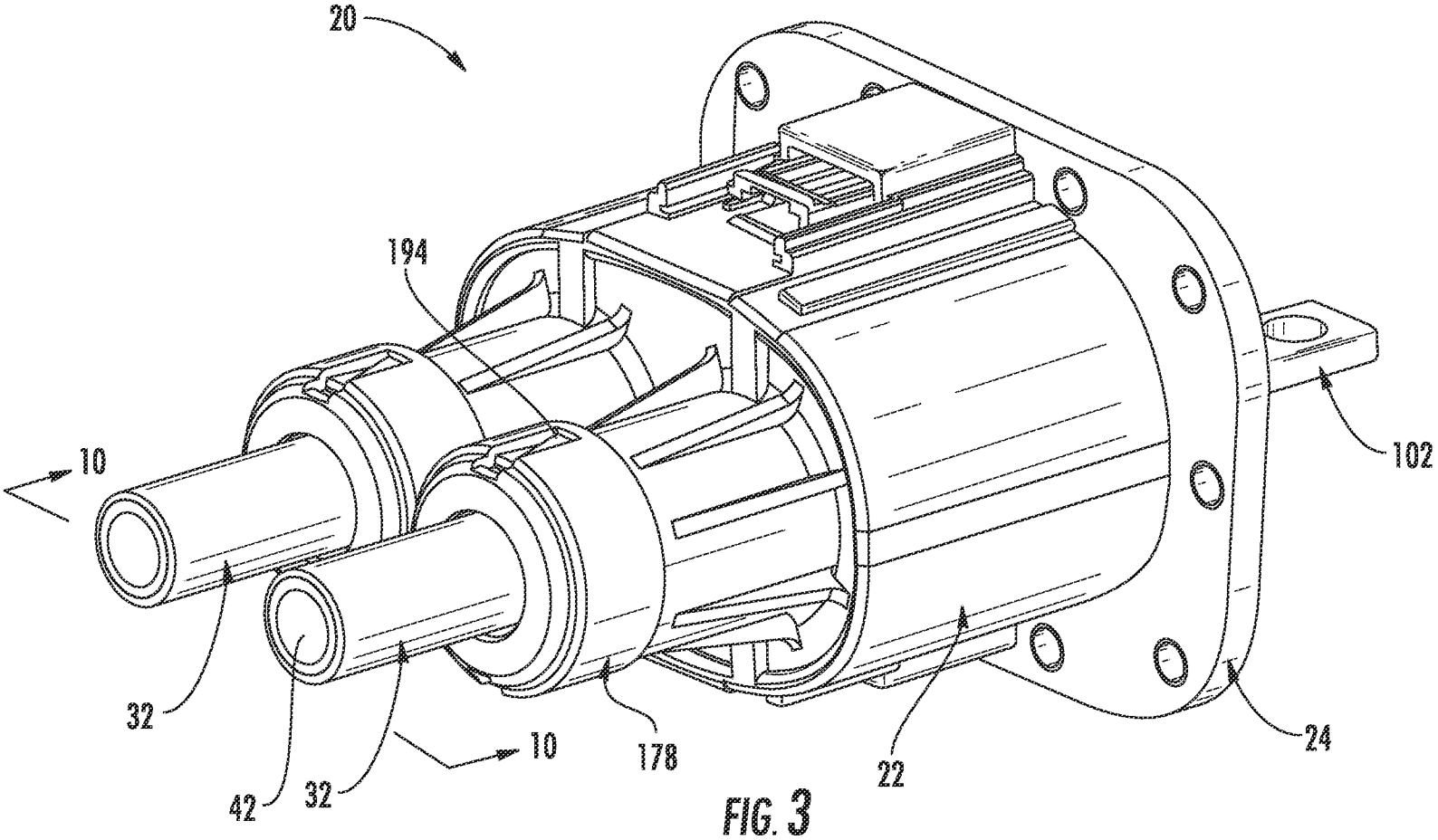
FIG. 3 is a front perspective view of the embodiment depicted in FIG. 2.
Figure 4:
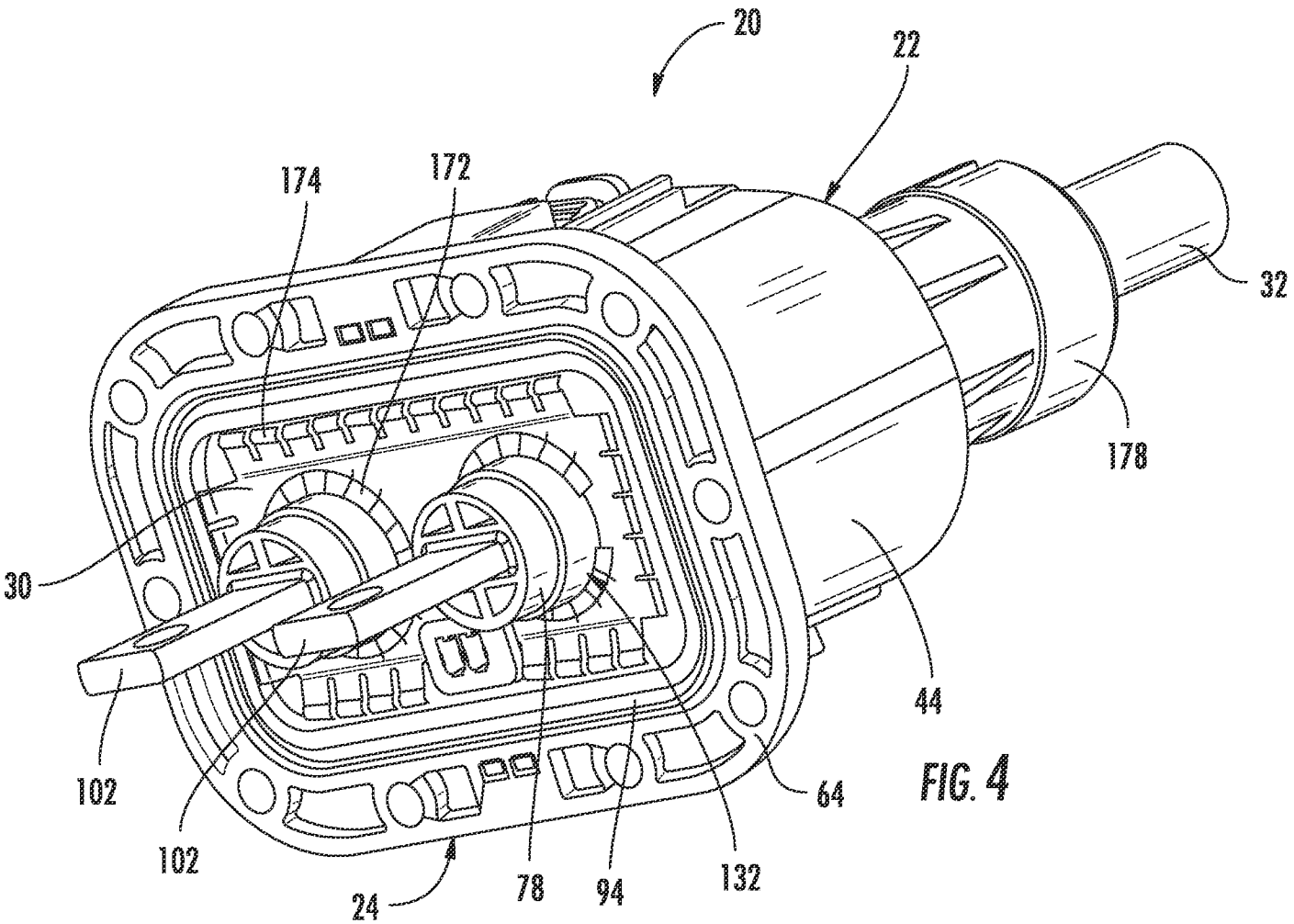
FIG. 4 is a rear perspective view of the embodiment depicted in FIG. 2.
Figure 5:
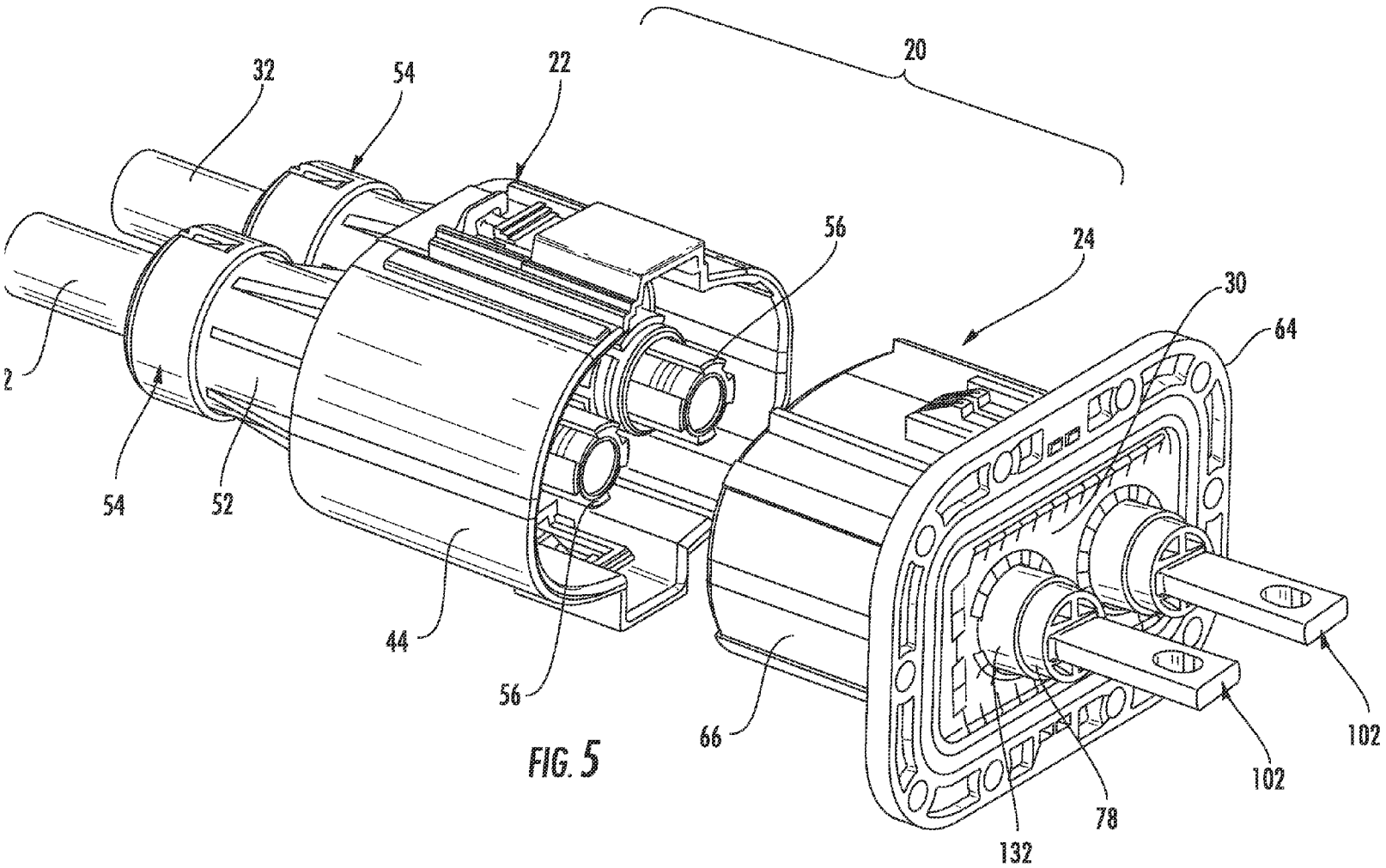
FIG. 5 is an partially exploded rear perspective view of the embodiment depicted in FIG. 2.
Figure 6:
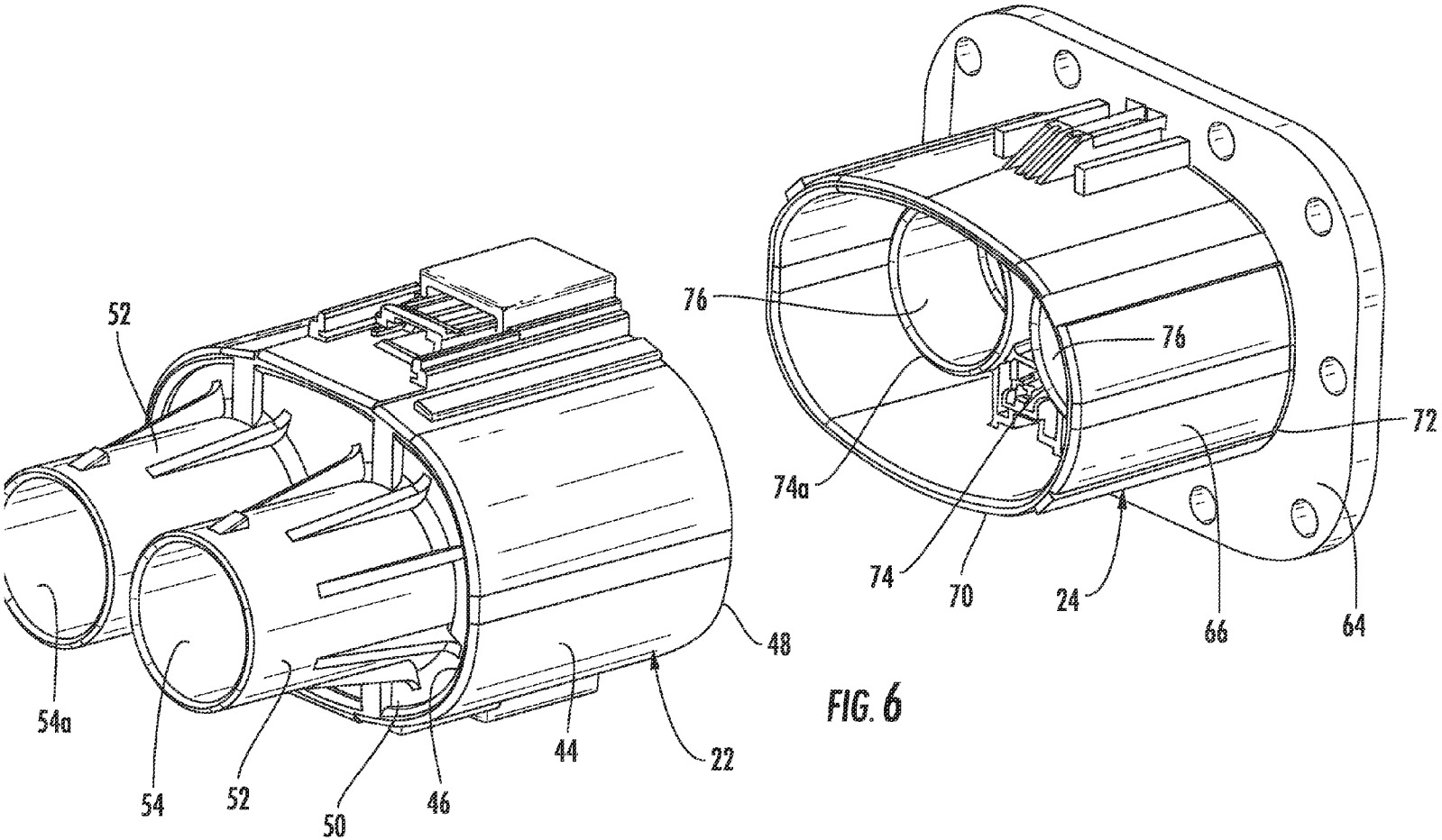
FIG. 6 is a simplified, partially exploded front perspective view of the housings of the embodiment depicted in FIG. 2.
Figure 7:
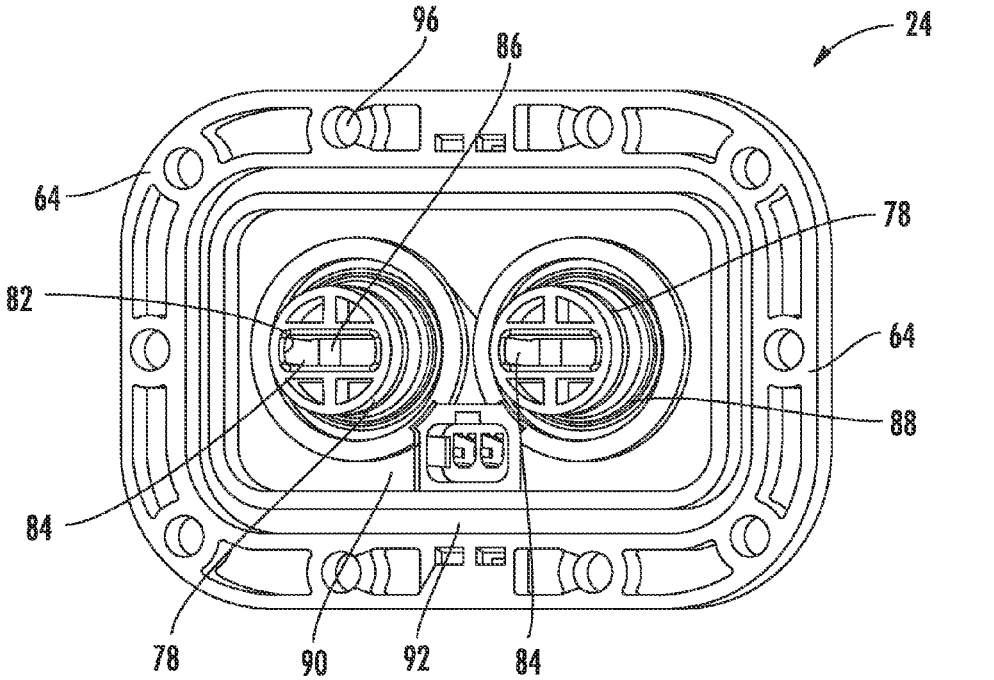
FIG. 7 is another rear perspective view of the embodiment depicted in FIG. 6.
Figure 7:
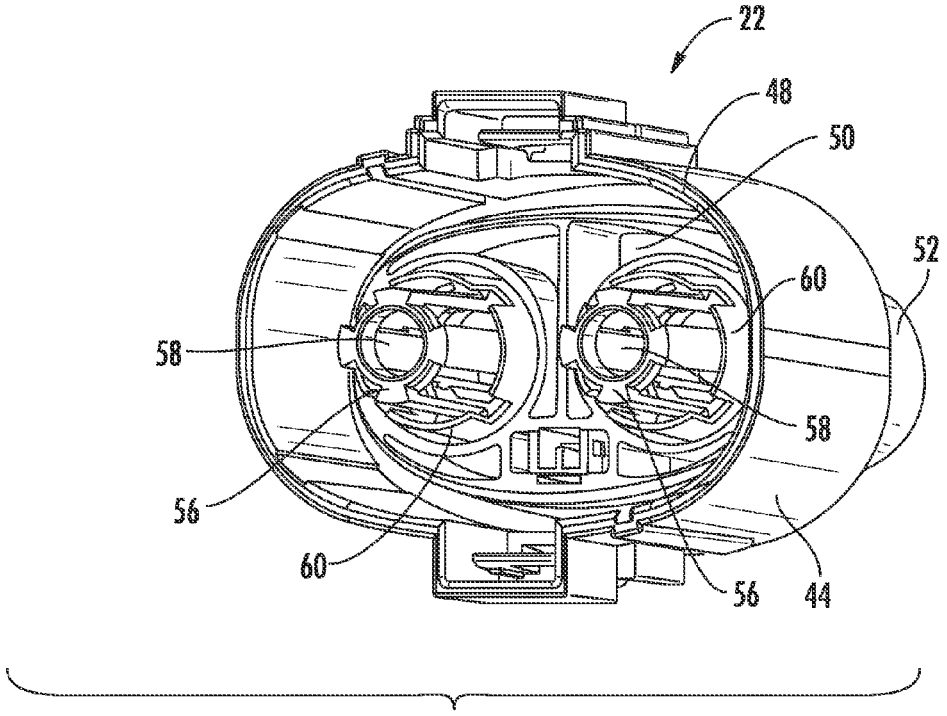
Figure 8:
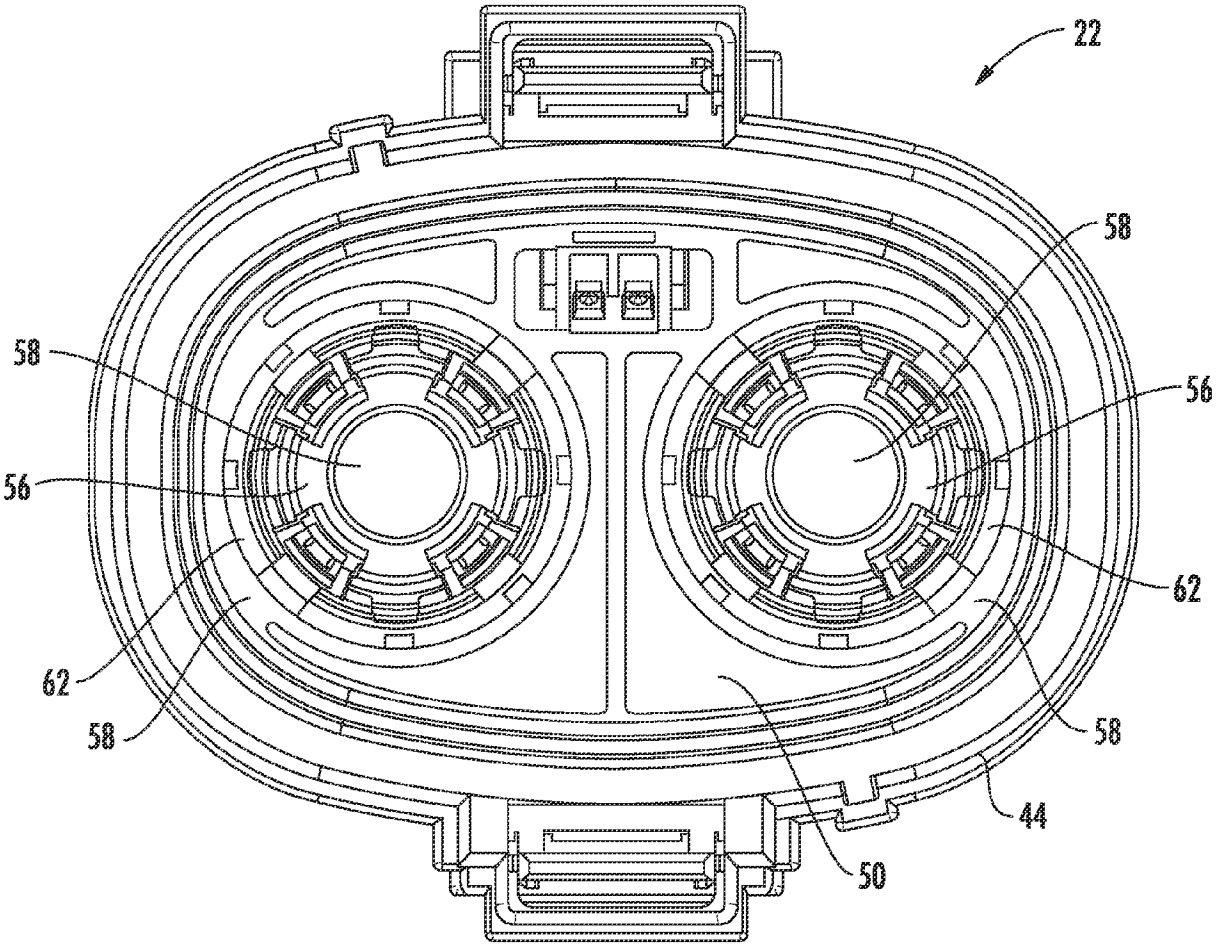
FIG. 8 is a front elevational view of an embodiment of a first housing.
Figure 9:
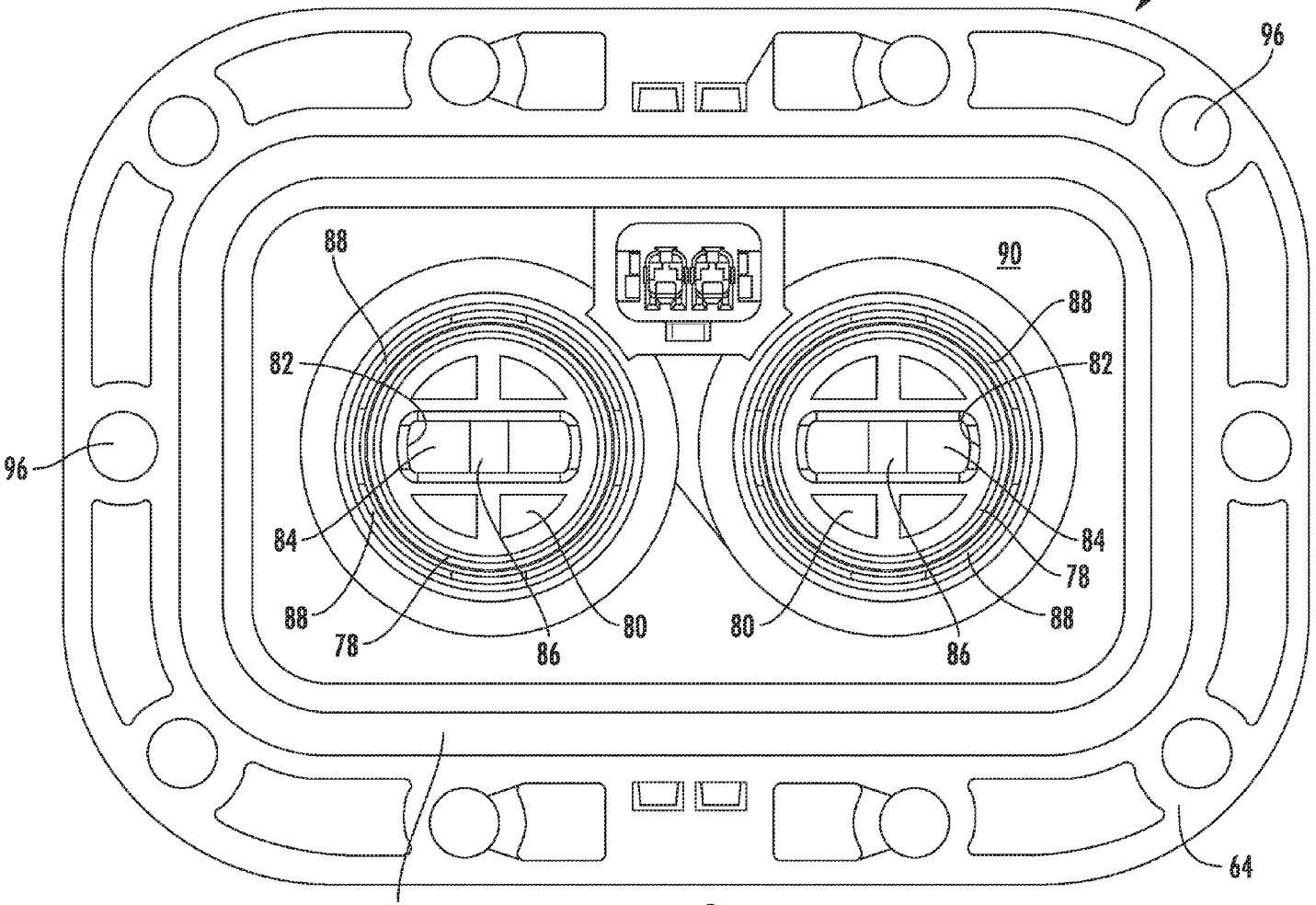
FIG. 9 is a front elevational view of an embodiment of a second housing.
Figure 10:
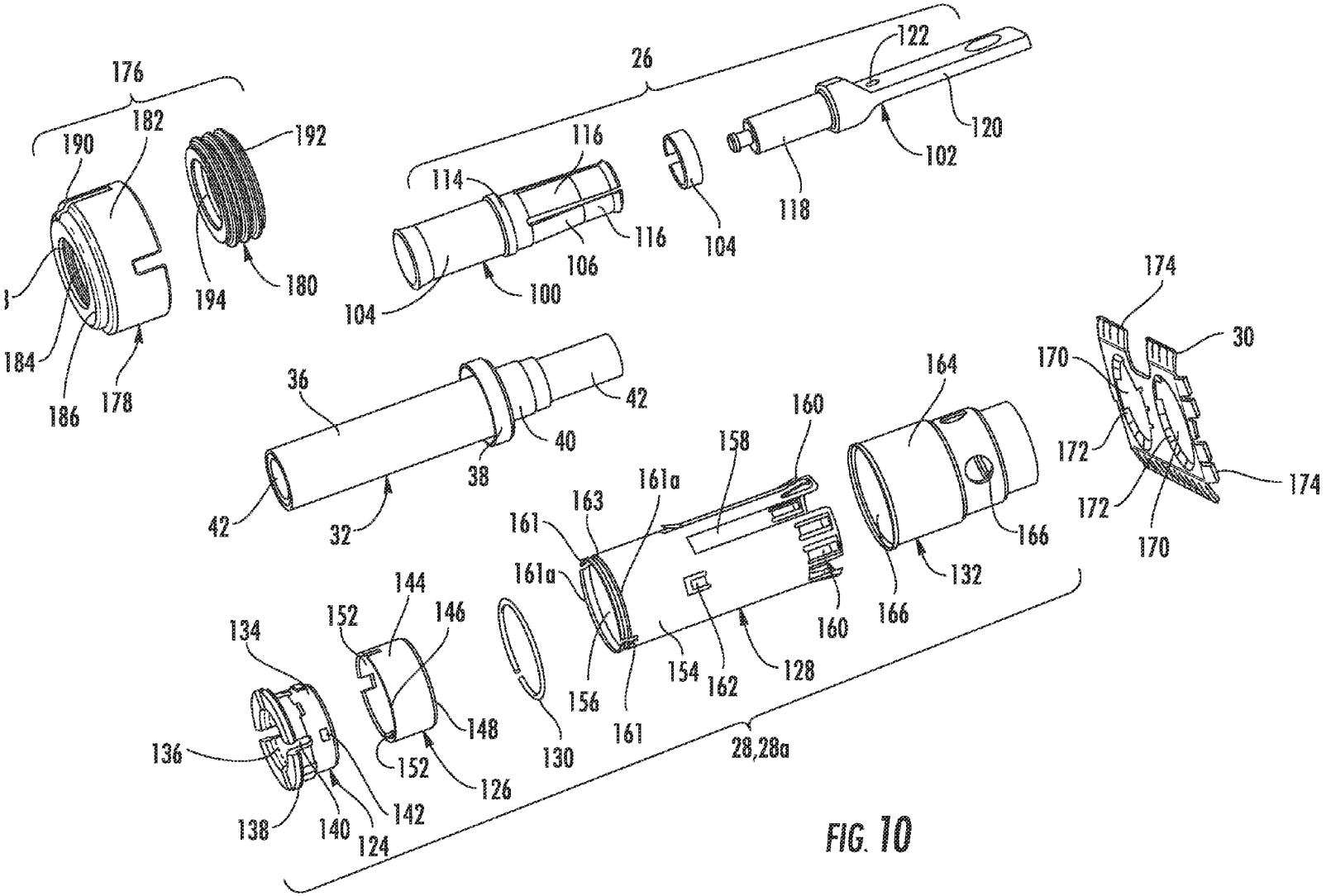
FIG. 10 is an partial, exploded perspective view of components of the embodiment depicted in FIG. 2.
Figure 11:
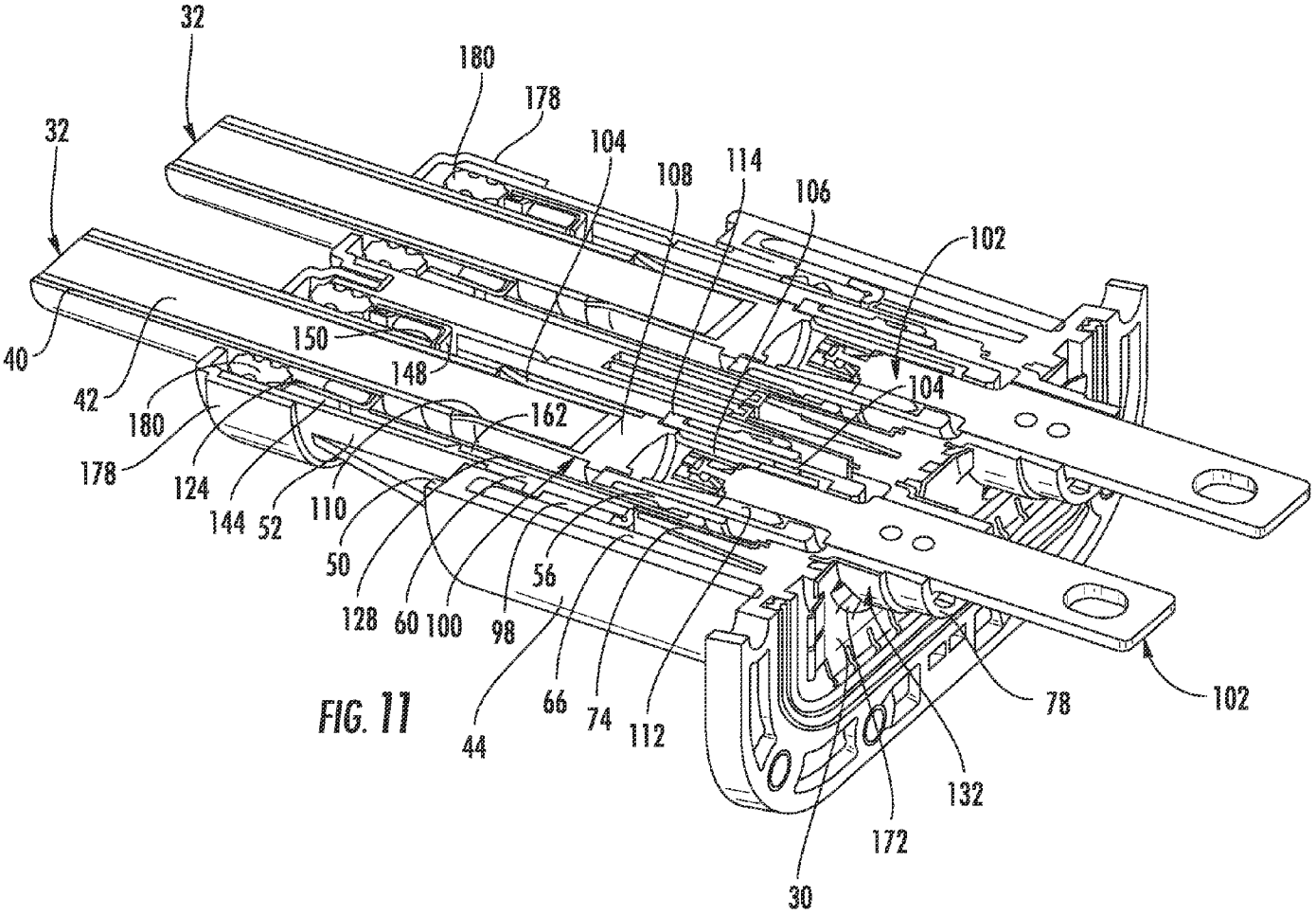
FIG. 11 is an cross-sectional view of embodiment depicted in FIG. 3, taken along line 10-10.
Figure 12:
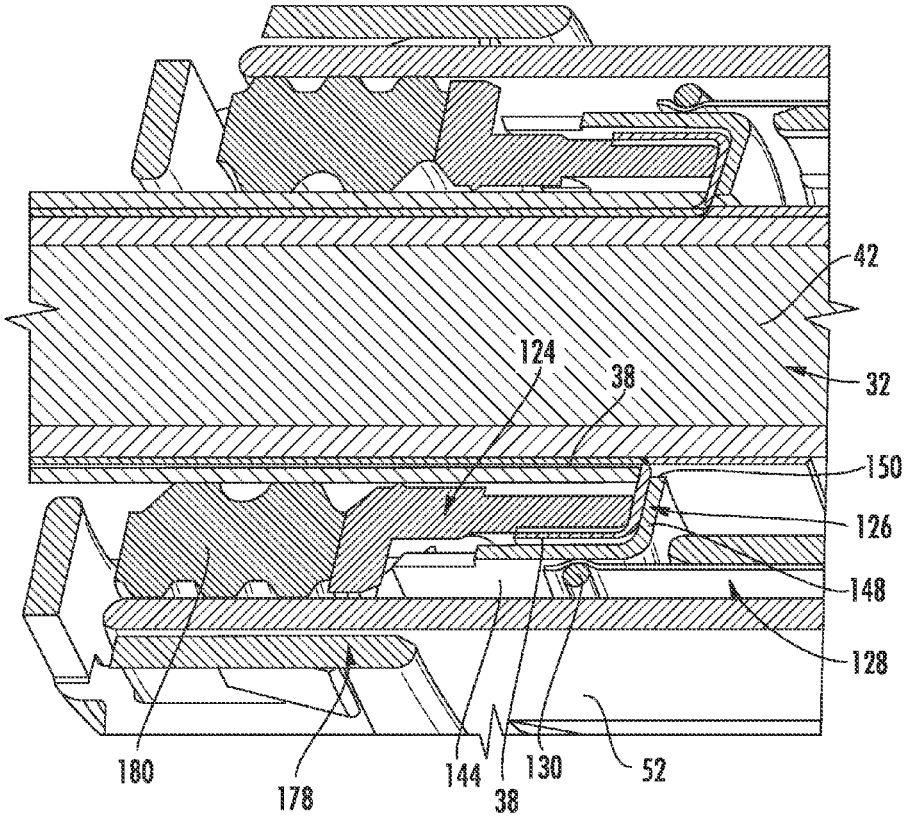
FIG. 12 is an enlarged cross-sectional view of the embodiment depicted in FIG. 11.
Figure 13:
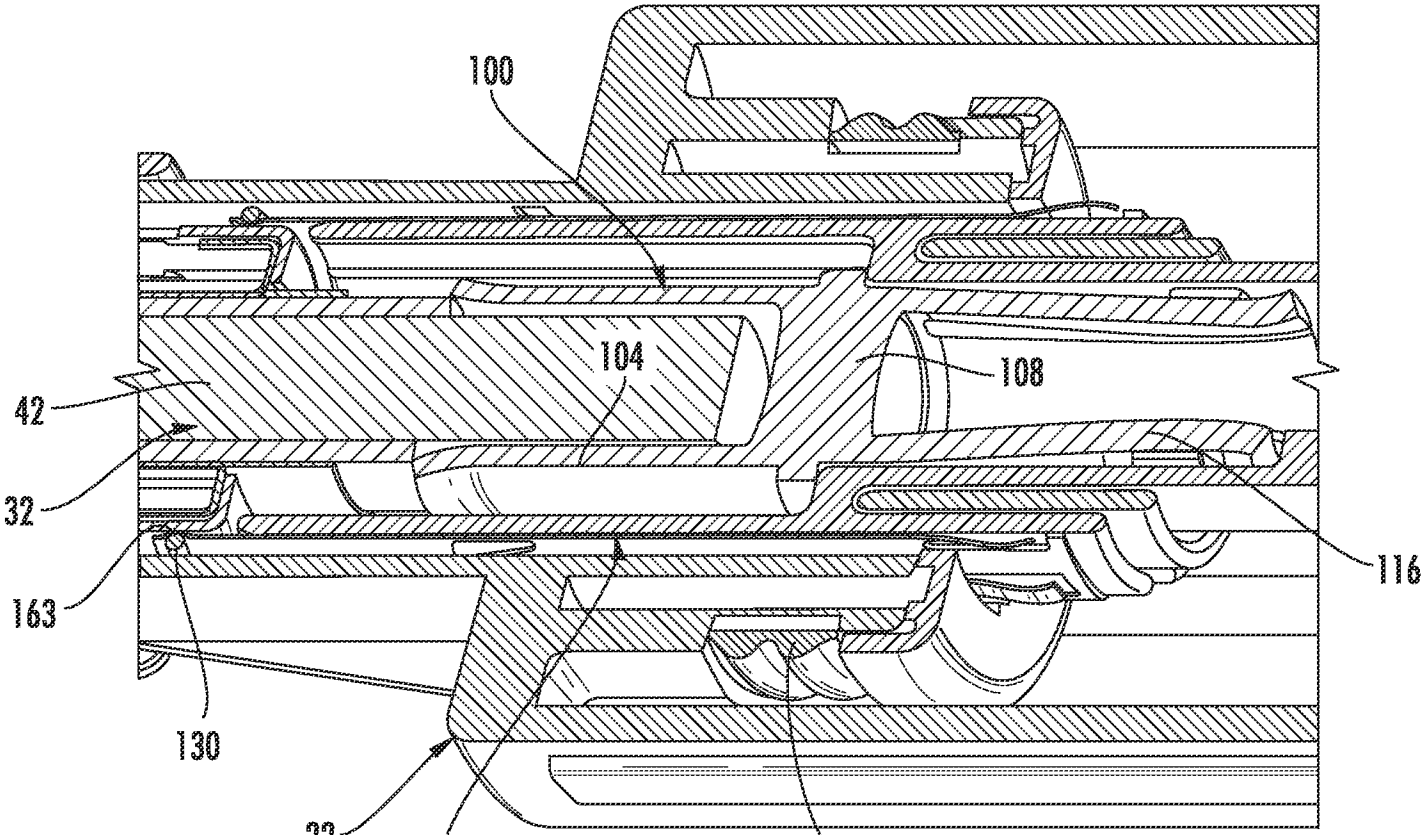
FIG. 13 is another enlarged cross-sectional view of the embodiment depicted in FIG. 11.
Figure 14:
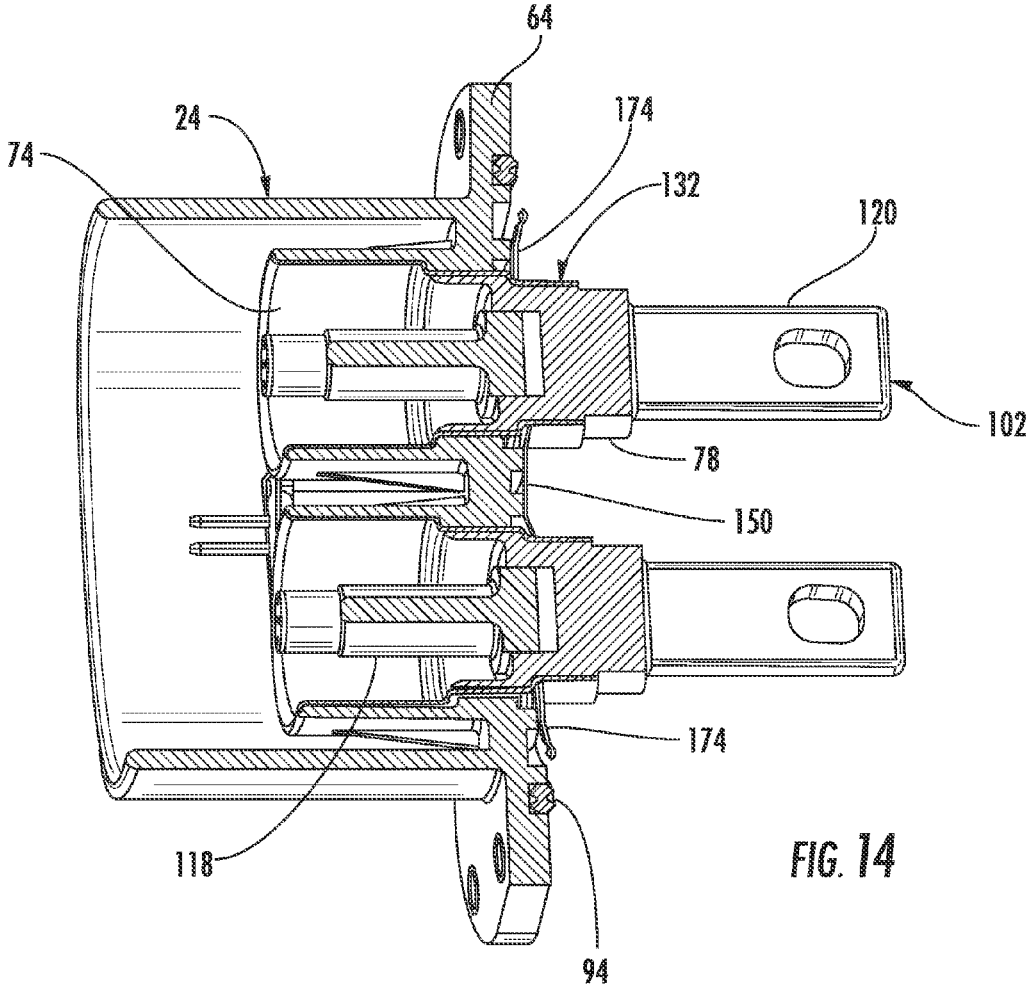
FIG. 14 is an enlarged partial cross-sectional view of the embodiment depicted in FIG. 11 with the first housing part omitted for purposes of clarity.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein. Therefore, unless otherwise noted, features disclosed herein may be combined together to form additional combinations that were not otherwise shown for purposes of brevity. While the terms upper, lower and the like are used herein, these terms are used for ease in describing the invention and do not denote a particular required orientation for use of the invention.

The embodiments discussed below address certain issues that Applicants have determined exist in existing designs. For example, in certain applications it would be beneficial to allow the two cables to rotate independently from each other and from the connector so that the handling of the connector could be improved but existing designs don't offer this functionality. In addition, for certain applications it would be beneficial to allow the current on the two shields to cancel out in a manner that reduces the impedance between the two shields. Certain features of the described embodiments can help address these issues. Naturally, features can be removed from a connector if the additional cost of the feature outweighs its usefulness in a particular application. Thus, various levels of connectors with various levels of features are possible.

Turning to the figures, a high power electrical connector 20 includes a housing formed from a first housing part 22 which mates to a second housing part 24. A pair of contact path assemblies 26 and a pair of ground path assemblies 28 and a ground plate 30 are mounted to the housing parts 22, 24. The combination of two ground path assemblies 28 and the ground plate 30 define a ground path connection **28*a* (what could be referred to as down and back along two ground path assemblies) between two conductive shields 38 that are being used to provide signals and/or power. The contact path assemblies 26 provides paths for electrical signals (e.g., power) to travel from a pair of cables 32 to which the contact path assemblies 26 are respectively attached through the housing parts 22, 24 to an associated member (not shown) to which the contact path assemblies 26 are attached. The contact path assemblies 26 and the ground path assemblies 28 are electrically isolated from each other. The cables 32 (which can be bipolar cables) can rotate relative to the housing part 22, 24 and relative to each other as a result of the structure of the contact path assemblies 26 as described herein. The electrical connector 20 is suitable for electrically connecting to larger gauges of conductors (such as gauges greater than 6 gauge). The ground path assemblies 28 and ground plate 30 provide a ground path to ground the cables 32 to an associated dash panel 34. The electrical connector 20** can carry high amounts of voltage and current, for example 200 to 400 amps.

The use of two cables to provide power is known in the art and this is sometimes referred to bipolar (BP) cables. The cables 32 are elongate and each includes an inner conductive conductor 42 that is configured to carry a high current load, an insulative sheath 40 surrounding the inner conductor 42, a conductive shield 38 surrounding the insulative sheath 40, and an outer insulative skin 36. The outer insulative skin 36 can be cut away to expose the conductive shield 38, as is known in the art, for grounding the cable 32. As is known, high current cable cables 32 are stiff heavy cables which can make repairs to the cable (or the components the cables are connected to) challenging. Therefore, allowing the cables 32 to rotate relative to the housing parts 22, 24 and to rotate relative to each other has been determined to aid in preventing damage to the cables 32 and to improve assembly flexibility and ease of use.

The first housing part 22 is formed of an insulative material and is preferably integrally formed. The first housing part 22 has a generally elliptical-shaped side wall 44 formed from an upper portion, a lower portion and side portions connecting the upper and lower portions. The side wall 44 defines a front end 46 and a rear end 48. The upper and lower portions are generally planar. The side portions are generally arcuate. A front wall 50 is provided at the front end 46 of the side wall 44 and a first pair of cylindrical extensions 52 extend from a front side of the front wall 50 and each defines a cylindrical passageway 54 therethrough. A second pair of cylindrical extensions 56 extend from a rear side of the front wall 50 and each defines a cylindrical passageway 58 therethrough. The passageways 54 and 58 align with each other, and apertures are formed through the front wall 50 to allow communication between the passageways 54 and 58, thereby forming central passageways 54/58. The extensions 56 preferably do not extend past the rear end 48 of the side wall 44. The wall forming the extensions 56 may be slotted as shown. A second pair of cylindrical extensions 60 extend from the rear side of the front wall 50. The cylindrical extensions 60 surrounds, and is spaced from, the respective first cylindrical extension 56. A plurality of spaced apart slots 62 are provided around each first cylindrical extension 56.

The second housing part 24 is formed of an insulative material and is preferably integrally formed. The second housing part 24 includes a plate 64 from which a generally elliptical-shaped side wall 66 extends. The side wall 66 is the same shape as the side wall 44 of the first housing part 22, except that the side wall 66 is smaller so that it fits within the side wall 44 when the housing parts 22, 24 are mated together. Accordingly, the side wall 66 defines a front end 70 and a rear end 72. The side wall 66 is formed from an upper portion, a lower portion and side portions connecting the upper and lower portions. The upper and lower portions are generally planar. The side portions are generally arcuate. A pair of spaced apart cylindrical extensions 74 extend from a front side of the plate 64 and are provided within the side wall 66. Each cylindrical extension 74 has a cylindrical passageway 76 defined therein. A front end of each cylindrical extension 74 preferably does not extend past a front end of the side wall 66. A pair of cylindrical extensions 78 extend from a rear side of the plate 64. A rear wall 80, 80*a* closes the rear end of each cylindrical extensions 78, with the exception of an elliptical shaped aperture 82 provided at the center thereof. The aperture 82 has planar top and bottom surfaces and arcuate side walls. An elongated passageway 84 extends through the respective cylindrical extensions 78 and is in communication with the respective aperture 82. A bar 86 extends across each aperture 82 from the planar top surface to the planar bottom surface. Apertures are formed through the plate 64 to allow communication between the passageways 76. Respective passageways 76, 78 align with each other and with the respective aperture 82 to form a central passageway 76/78/82. Arcuate slots 88 are provided through the plate 64 and are formed around each extension 78.

The rear surface of the plate 64 has a generally rectangular recess 90 therein and the extensions 78 extend outwardly from the recess 90. A groove 92 is provided in the rear surface of the plate 64 and extends around the perimeter of the recess 90 and is spaced therefrom. An elastomeric seal 94 seats within the groove 92 for sealing the second housing part 24 to the dash panel 34. A plurality of mounting apertures 96 are provided between the groove 92 and the perimeter of the plate 64. Fasteners (not shown) are mounted in the mounting apertures 96 for mounting the second housing part 24 to the dash panel 34.

The side wall 66 of the second housing part 24 seats within the side wall 44 of the first housing part 22 when the housing parts 22, 24 are assembled together. Respective extension 56 seat within associated extension 74. A seal member 98 is provided between the extension 60 and the side wall 66. The housing parts 22, 24 are suitably secured to each other such as by snap-fit lock features/tongue and groove and the like, which are known in the art.

The contact path assemblies 26 can be identical and therefore only one of the contact path assemblies 26 is described. The contact path assembly 26 includes a conductive inner conductor 100 which is mounted in the first housing part 22 and which is attached to the inner conductor 42 of the cable 32, a conductive contact 102 which is mounted in the second housing part 24 and which is connected to the conductor 100, and a conductive c-clip 104 which connects the conductor 100 to the contact 102. The conductor 100 and the contact 102 form an electrical path through the housings 22, 24. The conductor 100 is rotatably attached to the contact 102. As a result, the conductor 100 and the cable 32 are rotatable relative to the housing parts 22, 24.

The conductor 100 is formed from a first cylindrical wall 104, a second cylindrical wall 106 and a central wall 108 between the walls 104, 106. The first wall 104 and the central wall 108 define a bind bore 110 therein; the second wall 106 and the central wall 108 define a bind bore 112 therein. A flange 114 extends outwardly from the central wall 108. The first wall 104 has a front end which flares outwardly. The second wall 106 has four equi-distantly spaced slots which extend from the rear end toward the central wall 108 to define a plurality of legs 116 which can be compressed toward each other. The rear end of the second wall 106 flares outwardly.

The conductor 100 seats within the central passageway 54/58 of the first housing part 22 and the legs 116 seat within the extension 56.

The contact 102 has a front portion 118 which is cylindrical and a rear portion 120 which forms a flat blade. An aperture 122 is provided through the rear portion 120 proximate to the front end thereof. The contact 102 is mounted in the second housing part 24 and such that the front portion 118 seats within the passageway 76 in the extension 74, the rear portion 120 seats within the passageway 84 in the extension 78 and extends outwardly from the aperture 82. The bar 86 extends through the aperture 122. As a result of this structure, the contact 102 cannot rotate relative to the second housing part 24.

The front portion 104 of the conductor 100 seats over the exposed portion of the inner conductor 42 of the cable 32. The front portion 104 of the inner conductor 100 is crimped to the inner conductor 42 to electrically connect the inner conductor 100 to the inner conductor 42.

The rear portion 106 of the conductor 100 seats over the cylindrical front portion 118 of the contact 102. The C-clip 104 engages over the rear portion 106 of the conductor 100 to cause the legs 116 to compress and engage with the cylindrical front portion 118 of the contact 102. The c-clip 104 provides sufficient compressive force to cause the electrical connection, however, the c-clip 104 does not provide such a compressive force that prevents rotation between the conductor 100 and the contact 102.

The ground path assemblies 28 are identical and therefore only one of the ground path assemblies 28 is described. The ground path assembly 28 includes a conductive ferrule 124, a conductive cap 126, a sleeve formed from an inner conductive sleeve part 128 and an outer conductive sleeve part 132, and a metal C-clip 130.

The ferrule 124 has a cylindrical side wall 134 having a front end and a rear end, a cylindrical passageway 136 therethrough, and a circular flange 138 extending outwardly from the front end of the side wall 134. Spaced apart slots 140 extend through the flange 138 and extend a predetermined distance along the side wall 134. Spaced apart protrusions 142 extend from the exterior surface of the side wall 134 and respectively align with the slots 140, but are spaced therefrom.

The conductive cap 126 has a cylindrical side wall 144 having a front end and a rear end and a cylindrical passageway 146 therethrough. A rear wall 148 closes the rear end of side wall 144 and a circular aperture 150 through the rear wall 148 is in communication with the passageway 146. A pair of diametrically opposed tabs 152 is defined at the front end of the side wall 144 and the tabs 152 are formed by slots through the side wall 144.

The sleeve part 128 is formed from a cylindrical side wall 154 having a front end and a rear end and a cylindrical passageway 156 therethrough. A pair of diametrically opposed slots 158 extend from the rear end of the sleeve part 128 forwardly a predetermined distance. A plurality of spaced apart tabs 160 are punched from the sleeve part 128 and extend outwardly therefrom. The tabs 160 are provided proximate to, but spaced from, the rear end of the sleeve part 128. A plurality of tabs 162 are punched from the side wall 154 and are proximate to the front end of the slots 158. A pair of diametrically opposed slots 161 extend from the front end of the sleeve part 128 forwardly a predetermined distance to define legs 161*a* at the front end of the sleeve part 128. A groove 163 is provided at the front end of the sleeve part 128 for accepting the c-clip 130 therein. The groove 163 is interrupted by the slots 161.

The outer sleeve part 132 is formed from a cylindrical side wall 164 having a front end and a rear end and a cylindrical passageway 166 therethrough. A plurality of spaced apart apertures 168 are provided through the side wall 164. The outer sleeve part 132 can include a plurality of stepped portions as shown in the drawings.

The ground plate 30 is formed from a thin conductive plate which has a pair of circular cutouts 170 therethrough. The circular cutouts 170 define a plurality of flexible fingers 172. The perimeter of the ground plate 30 has a plurality of flexible fingers 174 extending therefrom.

The assembly of the ground path assemblies 28 with the cables 32 can be identical and therefore only one is described. To assemble the ground path assembly 28 with the cable 32, the shield of the cable 32 is first pulled back to wrap a portion of the shield 38 backwardly over the remainder of the cable 32 and to form a bend in the shield 38.

The cable 32 extends through the cylindrical passageway 136 in the ferrule 124 and the ferrule 124 is placed under the wrapped back portion of the shield 38. Alternatively, the ferrule 124 can first be seated on the cable 32 and the portion of the shield 38 wrapped backwardly over the ferrule 124. As a result, the wrapped back portion of the shield 38 extends forwardly over the exterior surface of the ferrule 124 a predetermined distance.

The cable 32 extends through the aperture 150 in the cap 126 such the wall forming the aperture 150 abuts against the insulative sheath 40 of the cable 32, the rear wall 148 of the cap 126 abuts against the bend in the wrapped shield 38 and the side wall 144 of the cap 126 seats over the wrapped back portion of the shield 38. The front end of the cap 126 abuts against the flange 138 of the ferrule 124. The slots 140 and protrusions 142 on the ferrule 124 aid in attaching the ferrule 124 to the cable 32. The tabs 152 on the cap 126 aid in attaching the cap 126 to the ferrule 124. The connected ferrule 124, cable 32 and cap 126 seat within the extension 52 of the first housing part 22. As such, the wrapped back portion of the shield 38 of the cable 32 is sandwiched between the interior surface of the side wall 144 of the cap 126 and the exterior surface of the side wall 134 of the ferrule 124.

The forward end of the sleeve part 128 seats over the side wall 144 of the cap 126. The c-clip 130 seats within the groove 163 and the legs 161*a* of the sleeve part 128 compress inwardly to attach sleeve part 128 to the side wall 144 of the cap 126. The cap 126 can rotate relative to the sleeve part 128. The c-clip 130 provides sufficient compressive force to cause the electrical connection between the sleeve part 128 and the cap 126, however, the c-clip 130 does not provide such a compressive force that prevents rotation between the sleeve part 128 and the cap 126. Since the c-clip 130 is provided, a softer material can be used for the sleeve part 128 while ensuring a reliable electrical connection between the sleeve part 128 and the cap 126. The sleeve part 128 seats partially in the extension 52, extends through the aperture in the front wall 50 of the first housing part 22 and seats through the slots 62 surrounding the extension 60. The first housing part 22 fills the slots 158 in the sleeve part 128 to connect the sleeve part 128 to the first housing part 22. The tabs 162 engage with the first housing part 22.

The sleeve is formed by seating the front end of the outer sleeve part 132 over the rear end of the inner sleeve part 128. The outer sleeve part 132 seats over and engages with the tabs 160 on the inner sleeve part 128. The engagement of the tabs 160 with the internal surface of the outer sleeve part 132 ensures a reliable electrical connection between the outer sleeve part 132 and the inner sleeve part 128. The outer sleeve part 132 extends through slots 88 and encircles the extension 78 of the second housing part 24. The second housing part 24 extends through the apertures 166 in the outer sleeve part 132 to prevent the removal of the outer sleeve part 132 from the second housing part 24.

The ground plate 30 seats within the recess 90 of the second housing part 24 and generally conforms to the shape of the recess 90. The plurality of flexible fingers 172 engage with the rear end of the outer sleeve part 132 to provide a reliable electrical connection between the ground plate 30 and the outer sleeve part 132. The plurality of flexible fingers 174 extend outwardly from the recess 90 for engagement with the dash plate 34 to provide a reliable electrical connection between the ground plate 30 and the dash plate 34.

As a result of this structure, grounding of the cable 32 is provided. The shield 38 is electrically connected to the cap 126; the cap 126 is electrically connected to the inner sleeve part 128; the inner sleeve part 128 is electrically connected to the outer sleeve part 132; the outer sleeve part 132 is electrically connected to the ground plate 30. The ground plate 30 is grounded to the dash panel 32.

A pair of end cap and seal assemblies 176 which includes an end cap 178 and a seal 180 provides waterproof seals with the respective cables 32 at the front end of the first housing part 22. The end cap and seal assemblies 176 are identical and their assembly with the first housing part 22 and the cables 32 are identical, and therefore, only a single end cap and seal assembly 176 and its assembly is described. The end cap and seal assembly 176 which includes an end cap 178 and an elastomeric seal 180. The end cap 178 is formed from a cylindrical side wall 182 having a front end and a rear end and a cylindrical passageway 184 therethrough. A front wall 186 closes the front end of the side wall 182 and has a circular aperture 188 provided therethrough which is in communication with the passageway 184. A pair of slots 190 are provided through the side wall 182 and are diametrically opposed to each other.

The seal 180 seats within the end cap 178 and surrounds the cable 32. The seal 180 is formed of an elastomeric material with a body 190 having a central passageway 192 therethrough. The exterior surface of the body 190 has corrugations thereon and the internal surface forming the central passageway 192 has corrugations thereon. The cable 32 seats through the central passageway 192. The front end of the ferrule 124 abuts against the rear end of the seal 180. The seal 180 engages the interior surface of the extension 52 of the first housing part 22. The seal 180 has an outer diameter which is slightly larger than the internal diameter of the extension 52. As a result, the seal 180 is slightly compressed within the extension 52 to form a watertight seal. The end cap 178 seats over the front end of the extension 52 and is attached thereto by the slots 190 engaging with protrusions 194 on the extension 52. This prevents the seal 180 from disengaging from the cylindrical extension.

As a result of this structure, each cable 32, the conductor 100, the contact 102, the ferrule 124 and the cap 126 are affixed together and are mounted in the housing parts 22, 24. The cable 32, the conductor 100, the ferrule 124 and the cap 126, are non-rotatably affixed together. Since the contact 102 and the conductor 100 are rotatably connected to each other, and since the sleeve part 128 and the cap 126 are rotatably connected to each other, the affixed cable 32/conductor 100/cap 126/ferrule 124 combination can rotate relative to the contact 102, and thus can rotate relative to the housing parts 22, 24 when a user desires to rotate the cable 32. The seal 180 may rotate with this assembly, or may stay stationary with the second housing part 24. The two cables 32 can be rotated separately from each other if desired.

The structure of the electrical connector 20 provides a very low resistance, preferably between 1 and 100 milliohms (mΩ) and more preferably below 30 mΩ, between the conductive shields 38 of the two cables (e.g., along the ground path connection 28*a*). Naturally, improvements in impedance must be balanced with ease of assembly and cost (as further reductions in impedance generally require more expensive materials and higher contact forces and must be balanced with the resultant increased insertion forces and higher costs that will eventually limit the ability to further reduce impedance in a practical manner). Providing a connector with a resistance of about 1 mΩ or less might not be desirable from a cost and ease of use standpoint. The depicted design has been tested, for example, and can provide a resistance of about 9-10 mΩ. Therefore, for many applications aiming for a resistance of between 5 and 50 mΩ may be a more desirable target. Consequentially, in certain embodiments the ground path connection 28*a* can be configured so that the impedance can be low (e.g., less than 100 mΩ) for currents less than 80 amps.

While a preferred embodiment of the present invention is shown and described, it is envisioned that those skilled in the art may devise various modifications of the present invention without departing from the spirit and scope of the appended claims.

What is claimed is:

1. A high power electrical connector comprising:

an insulative housing;

a first electrical path formed through the housing for transmitting electrical signals through the housing to an associated member;

a first cable having an inner cable conductor attached to the first electrical path for transmitting electrical signals to the first electrical path;

a second electrical path formed through the housing for transmitting electrical signals through the housing to the associated member; and a second cable having an inner cable conductor attached to the second electrical path for transmitting electrical signals to the second electrical path, wherein the first and second cables can rotate relative to the housing and relative to each other, wherein the first electrical path comprises a first conductor mounted in the housing and affixed to the inner conductor of the first cable and a first contact non-rotatably mounted in the housing, the first conductor being rotatably connected to the first contact, and the second electrical path comprises a second conductor mounted in the housing and affixed to the inner conductor of the second cable and a second contact non-rotatably mounted in the housing, the second conductor being rotatably connected to the second contact, and wherein the first conductor has a plurality of flexible legs which attach to the first contact, and the first electrical path further comprises a first c-clip for compressing the legs while still allowing relative rotation between the first conductor and the first contact, and wherein the second conductor has a plurality of flexible legs which attach to the second contact, and the second electrical path further comprises a second c-clip for compressing the legs of the second conductor while still allowing relative rotation between the second conductor and the second contact.

2. The high power electrical connector of claim 1, further comprising a first seal between the housing and the first cable and a second seal between the housing and the second cable.

3. The high power electrical connector of claim 1, wherein the first and second contacts comprise a cylindrical portion attached to the respective conductors and a flat blade portion extending from the housing for attachment to the associated member.

4. The high power electrical connector of claim 1, wherein each cable includes a conductive shield and the connector includes a ground path assembly connected to each of the conductive shields, the ground path assemblies configured to form a ground path connection between the two conductive shields that has a resistance of between one (1) and one hundred (100) milliohms (mΩ).

5. The high power electrical connector of claim 4, wherein the resistance is between five (5) and fifty (50) me.

6. A high power electrical connector of comprising:

an insulative housing;

a first electrical path formed through the housing for transmitting electrical signals through the housing to an associated member;

a first cable having an inner cable conductor attached to the first electrical path for transmitting electrical signals to the first electrical path;

a second electrical path formed through the housing for transmitting electrical signals through the housing to the associated member; and a second cable having an inner cable conductor attached to the second electrical path for transmitting electrical signals to the second electrical path, wherein the first and second cables can rotate relative to the housing and relative to each other, wherein each of the cables comprises an outer insulative skin, a conductive shield and an insulative sheath, the inner conductor and the conductive shield being exposed; and further comprising:

a first ground path assembly mounted in the housing, the first ground path assembly attached to the shield of the first cable, the first electrical path and the first ground path assembly being electrically isolated from each other by the housing and the first cable, the first cable and a portion of the first ground path assembly being rotatable relative to each other;

a second ground path assembly mounted in the housing, the second ground path assembly attached to the shield of the second cable, the second electrical path and the second ground path assembly being electrically isolated from each other by the housing and the second cable, the second cable and a portion of the second ground path assembly being rotatable relative to each other; and a ground plate mounted on the housing, the first and second ground path assemblies being connected to the ground plate.

7. The high power electrical connector of claim 6, wherein the first ground path assembly comprises a first conductive cap attached to the shield of the first cable, and a first conductive sleeve rotatably connected to the first cap, the first sleeve non-rotatably affixed to the housing; and wherein the second ground path assembly comprises a second conductive cap attached to the shield of the second cable, and a second conductive sleeve rotatably connected to the second cap, the second sleeve non-rotatably affixed to the housing.

8. The high power electrical connector of claim 7, wherein each sleeve includes a plurality of flexible legs, and further comprising a c-clip engaging the legs for causing the legs to compress and engage the respective cap.

9. The high power electrical connector of claim 7, wherein the ground plate comprises a plurality of fingers for engaging the sleeves, and the ground plate further comprises a plurality of fingers extending from a perimeter thereof for engaging an associated member.

10. The high power electrical connector of claim 7, wherein the first sleeve surrounds the first electrical path but is electrically isolated therefrom, and the second sleeve surrounds the second electrical path but is electrically isolated therefrom.

11. The high power electrical connector of claim 7, further including a first conductive ferrule attached to the first cable, the shield of the first cable being sandwiched between the first ferrule and the first cap, and a second conductive ferrule attached to the second cable, the shield of the second cable being sandwiched between the second ferrule and the second cap.

12. The high power electrical connector of claim 7, wherein each sleeve is formed from first and second parts.

13. The high power electrical connector of claim 12, wherein the first part of each sleeve includes a plurality of tabs which engage with the second part of the respective sleeve.

14. A high power electrical connector comprising:

first and second cables, each cable comprising an outer insulative skin, a conductive shield, an insulative sheath and an inner conductive conductor, the inner conductor and the conductive shield being exposed;

an insulative housing having a pair of passageways into which the cables are seated;

a first seal between the housing and the first cable;

a second seal between the housing and the second cable;

a first contact assembly formed through the housing for transmitting electrical signals through the housing, the first contact assembly comprising a first conductor mounted in the housing and non-rotatably connected to the inner conductor of the first cable, a first contact non-rotatably mounted in the housing, and a first c-clip for connecting the first conductor and the first contact together, the first conductor having a plurality of flexible legs which attach to the first contact, and the first c-clip compressing the legs while still allowing relative rotation between the first conductor and the first contact, the first contact extending outwardly from the housing for connection to an associated member;

a first ground path assembly mounted in the housing, the first ground path assembly comprising a first conductive cap attached to the shield of the first cable and a first conductive sleeve; the first cap rotatably connected to the first sleeve, the first sleeve non-rotatably affixed to the housing, the first contact assembly and the first ground path assembly being electrically isolated from each other by the housing and the first cable;

a second contact assembly formed through the housing for transmitting electrical signals through the housing, the second contact assembly comprising a second conductor mounted in the housing and non-rotatably connected to the inner conductor of the second cable, a second contact non-rotatably mounted in the housing, and a second c-clip for connecting the second conductor and the second contact together, the second conductor having a plurality of flexible legs which attach to the second contact, and the second c-clip compressing the legs while still allowing relative rotation between the second conductor and the second contact, the second contact extending outwardly from the housing for connection to the associated member;

a second ground path assembly mounted in the housing, the second ground path assembly comprising a second conductive cap attached to the shield of the second cable and a second conductive sleeve; the second cap rotatably connected to the second sleeve, the second sleeve non-rotatably affixed to the housing, the second contact assembly and the second ground path assembly being electrically isolated from each other by the housing and the second cable;

the first and second cables being rotatable relative to the housing and rotatable relative to each other; and a ground plate attached to the sleeves and in electrical contact with the associated member.

15. The high power electrical connector of claim 14, wherein the first and second contacts comprise a cylindrical portion attached to the respective conductors and a flat blade portion extending from the housing.

16. The high power electrical connector of claim 14, wherein each sleeve includes a plurality of flexible legs, and further comprising a c-clip engaging the legs for causing the legs to compress and engage the respective cap.

17. The high power electrical connector of claim 16, wherein each sleeve is formed from first and second parts, the first part of each sleeve includes a plurality of tabs which engage with the second part of the respective sleeve.

18. The high power electrical connector of claim 16, wherein the ground plate comprises a plurality of fingers for engaging the sleeves, and the ground plate further comprises a plurality of fingers extending from a perimeter thereof for engaging the associated member.

* * * * *